US005522681A

United States Patent [19]

Pallini, Jr.

[11] Patent Number: 5,522,681

[45] Date of Patent: Jun. 4, 1996

[54] THREAD SEAL FOR SEGMENTED NUT

[75] Inventor: Joseph W. Pallini, Jr., Tomball, Tex.

[73] Assignee: ABB Vetco Gray Inc., Houston, Tex.

[21] Appl. No.: 276,723

[22] Filed: Jul. 18, 1994

[51] Int. Cl.[6] ..... E02B 17/00

[52] U.S. Cl. ..... 405/223.1; 405/224; 405/195.1; 405/224; 166/350; 166/359; 166/367; 166/345

[58] Field of Search ..... 405/223.1, 224, 405/224.1, 224.2, 195.1, 224.3, 224.4; 285/355, 379; 403/369; 166/350, 359, 367, 338, 345

[56] References Cited

U.S. PATENT DOCUMENTS

| | | | |
|---|---|---|---|
| 4,516,882 | 5/1985 | Brewer et al. | 405/224 |
| 4,540,314 | 9/1985 | Falkner | 405/224 X |
| 4,585,369 | 4/1986 | Manesse et al. | 405/224 X |
| 4,871,282 | 10/1989 | Jennings | 405/224 |
| 4,989,902 | 2/1991 | Putch | 285/355 X |
| 5,020,942 | 6/1991 | Pallini . | |
| 5,244,313 | 9/1993 | Pallini . | |

*Primary Examiner*—Dennis L. Taylor
*Attorney, Agent, or Firm*—James E. Bradley

[57] ABSTRACT

A connector employs a segmented nut and a seal. The connector includes a housing with a bore having a bowl in it. A shaft extends through the bore, the shaft having exterior threads. Segments are carried on the bowl and move between a upper retracted position to an engaged position. A drive system slides the segments down and rotates them until threads from the segments align with the shaft threads. Each segment has a resilient seal which also has a portion of a thread for sealing against the threads of the shaft. An actuator will move the seals from an outboard position which occurs during rotation to a sealing position after rotation.

24 Claims, 5 Drawing Sheets

THREAD SEAL FOR SEGMENTED NUT

BACKGROUND OF THE INVENTION

1. Field of the Invention

This invention relates in general to segmented nuts for threaded shafts, and in particular a top connector assembly for connecting the upper end of a tendon to an offshore drilling production platform.

2. Description of the Prior Art

A tension leg platform is a type of offshore drilling structure. The platform floats and is secured to the sea floor by tendons. The tendons are large pipes, about 20–45 inches in diameter. After securing the tendons to the platform and to the sea floor, ballast water is pumped out to cause the platform to rise. The upward movement is resisted by the tendons, placing the tendons under tension load. The tendons under tension provide a stable platform for drilling and production.

U.S. Pat. No. 4,871,282, Charles E. Jennings, Oct. 3, 1989, U.S. Pat. No. 5,020,942, Joseph W. Pallini, Jr., Jun. 4, 1991; and U.S. Pat. No. 5,244,313, Joseph W. Pallini, Jr., et al., Sep. 4, 1993, describe top connectors for connecting the tops of the tendons to the platform. In the devices shown in these patents, the upper end of the tendon has helical threads. The threaded section extends through a housing which has conical bore or bowl. Segments or slips will slide down the conical bore from a retracted position to an engaged position. The segments have mating threads which will engage the threads on the tendon. A cam ring causes the downward movement of the segments and also rotates the segments and meshes the threads of the segments with the threads of the tendons.

The top connectors may be in a position exposed to sea water. It is desirable to protect the threaded areas from sea water. In the past, silicone rubber has been injected in the annulus between the housing and the shaft. Once cured, the silicone rubber provided the necessary low pressure protection of a seal, however the installation requires the use of a specialized curing agent and the use of divers. The silicone rubber also has a short pot life after mixing and requires equipment for mixing and injecting, as well as the cleaning of this equipment after injection.

SUMMARY OF THE INVENTION

In this invention, a plurality of resilient seals are employed. Each seal is a segment of a ring, carried by one of the segments. Each resilient seal has an inner side containing a portion of at least one seal thread. The seal thread aligns with the shaft threads when the segments are in their aligned position.

In the preferred embodiment, an actuator operates with the seal and the bowl to cause the seal to remain in an outboard position until the segments have been rotated by the drive system to the aligned position. In the outboard position, the seal is preferably spaced so that its thread is radially outward of the threads of the segments so that it will not be in contact with the threads of the tendon shaft while rotating. The actuator moves the seal into the inboard position after the rotational alignment has been completed.

The movement to the inboard position occurs by means of the actuator contacting a conical shoulder located in the bowl. The occurs prior to full make up of the segment threads with the shaft threads, but after rotational alignment. Upward movement of the housing relative to the shaft causes the actuator to push the segments into a full make up position and also to push the seal into the sealing position.

DETAILED DESCRIPTION OF THE INVENTION

Figure 1:
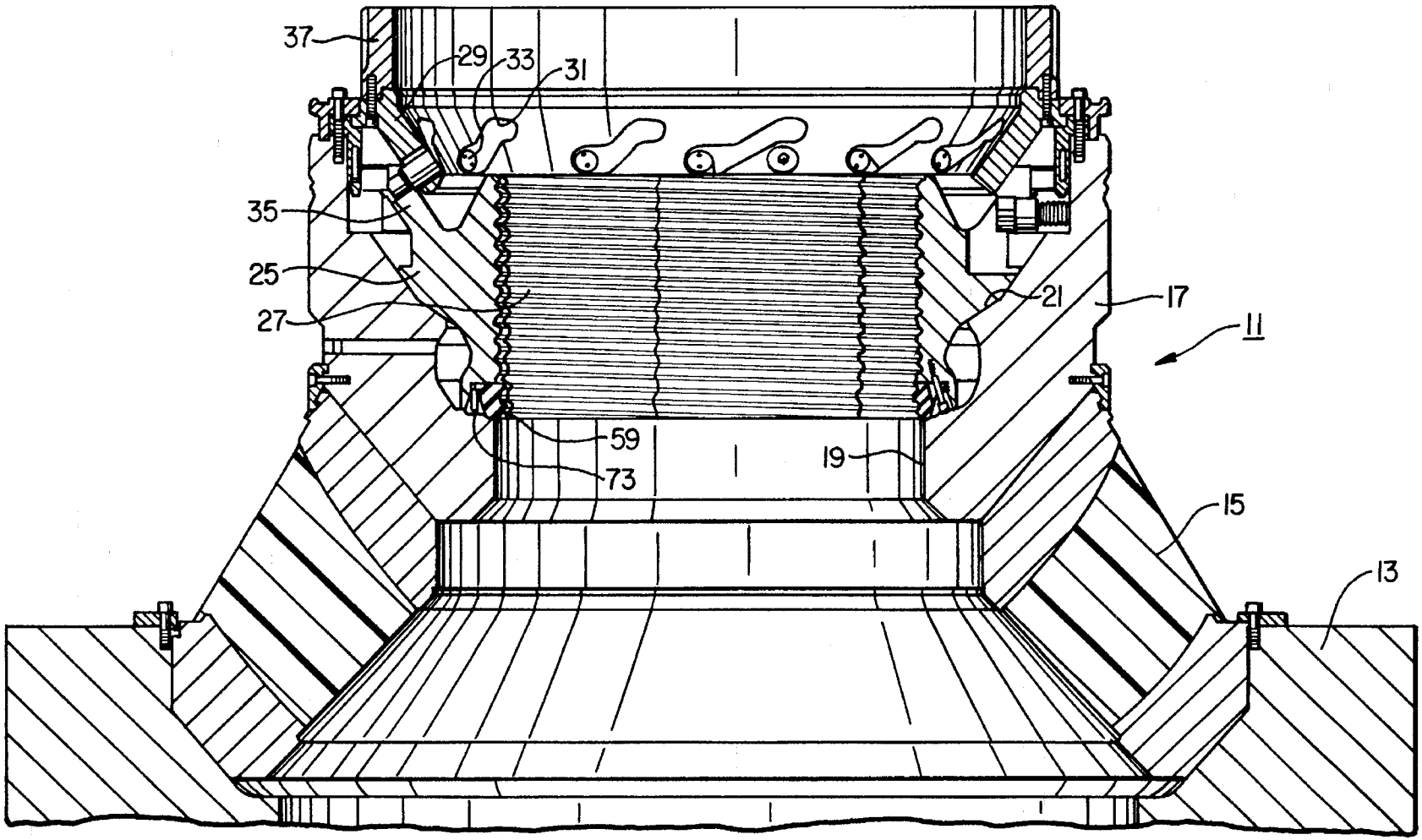
FIG. 1 is vertical sectional view illustrating a top connector constructed in accordance with this invention, but with the shaft omitted.

Referring to FIG. 1, top connector 11 will be mounted to an offshore drilling platform (not shown) at the bottom of the column of the platform. Top connector 11 includes a base 13 that mounts to the platform. A flexible element 15 is mounted to base 13. Flexible element 15 is a combination of metal and elastomeric plates. A housing 17 secures to the flexible element 15. Flexible element 15 allows housing 17 to twist and move angularly with wave movement.

Figure 2:
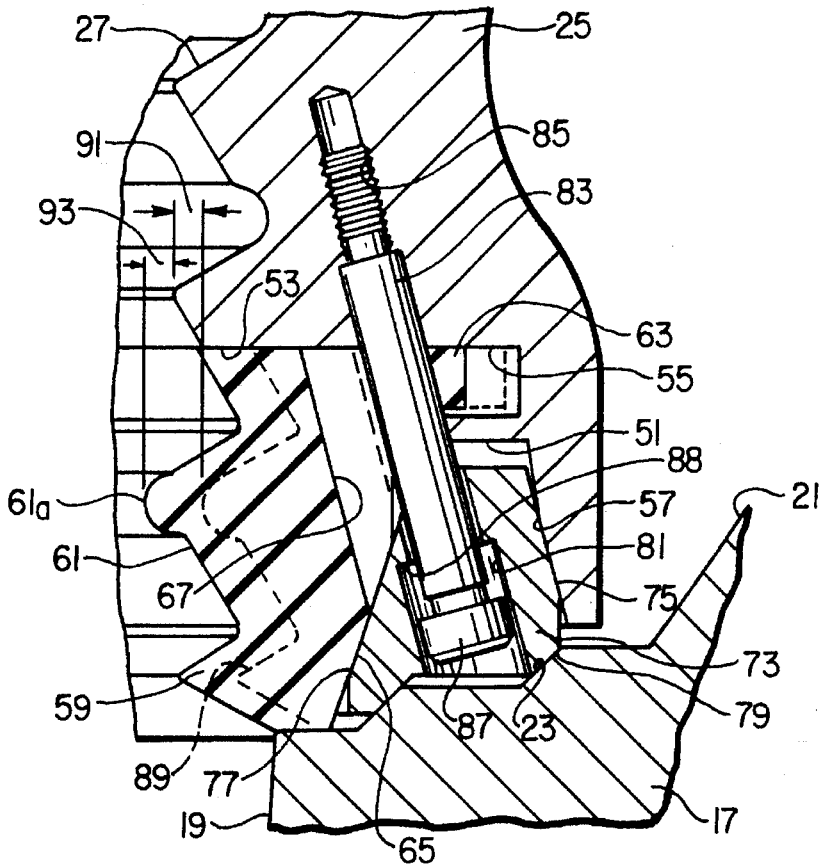
FIG. 2 is an enlarged sectional view of a portion of one of the seals employed with the top connector of FIG. 1.

Housing 17 has an axial bore 19 which has a lower cylindrical portion. The upper portion of bore 19 is a bowl 21 which has various conical surfaces formed therein. As shown in FIG. 2, two spaced apart conical shoulders 23 are located at the bottom of bowl 21 near the junction of the cylindrical portion of bore 19. Conical shoulders 23 taper at the same angle.

Figure 4:
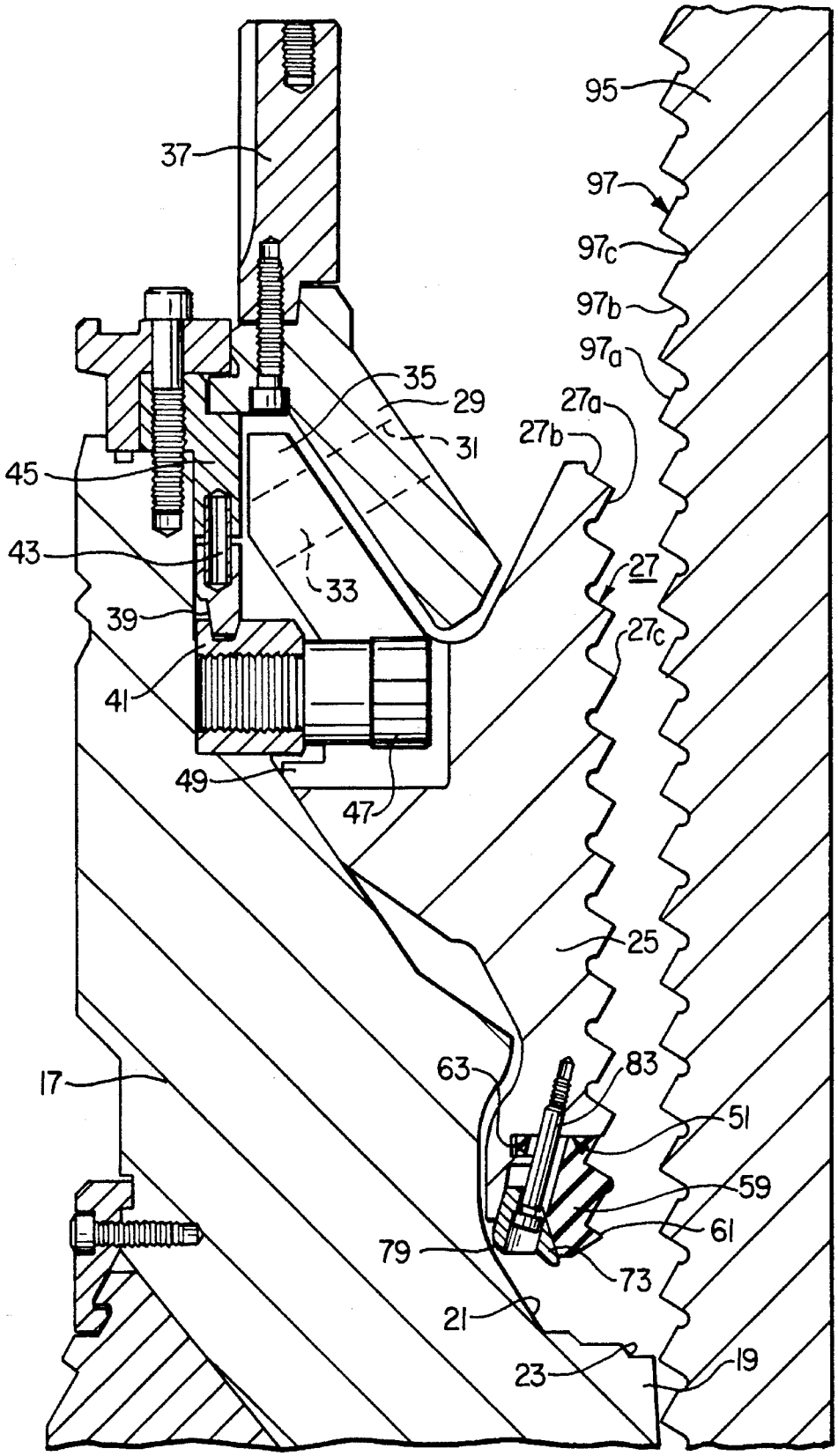
FIG. 4 is an enlarged sectional view of a portion of the top connector of FIG. 1, showing the segments in a retracted position and showing the shaft.

A plurality of segments 25, six in the preferred embodiment, are carried in bowl 21. Segments 25 have threads 27 on an inner side which align each other to make up a continuous helical threadform. As shown in FIG. 4, threads 27 are triangular, having a downward facing conical support flank 27*a* and a upward facing conical drive flank 27*b*. Flanks 27*a* and 27*b* intersect each other at a sharp crest 27*c*. Segments 25 will move between an upper or retracted position, shown in FIG. 4, to an aligned position shown in FIG. 5, and to a fully made up position shown in FIG. 6.

Figure 5:
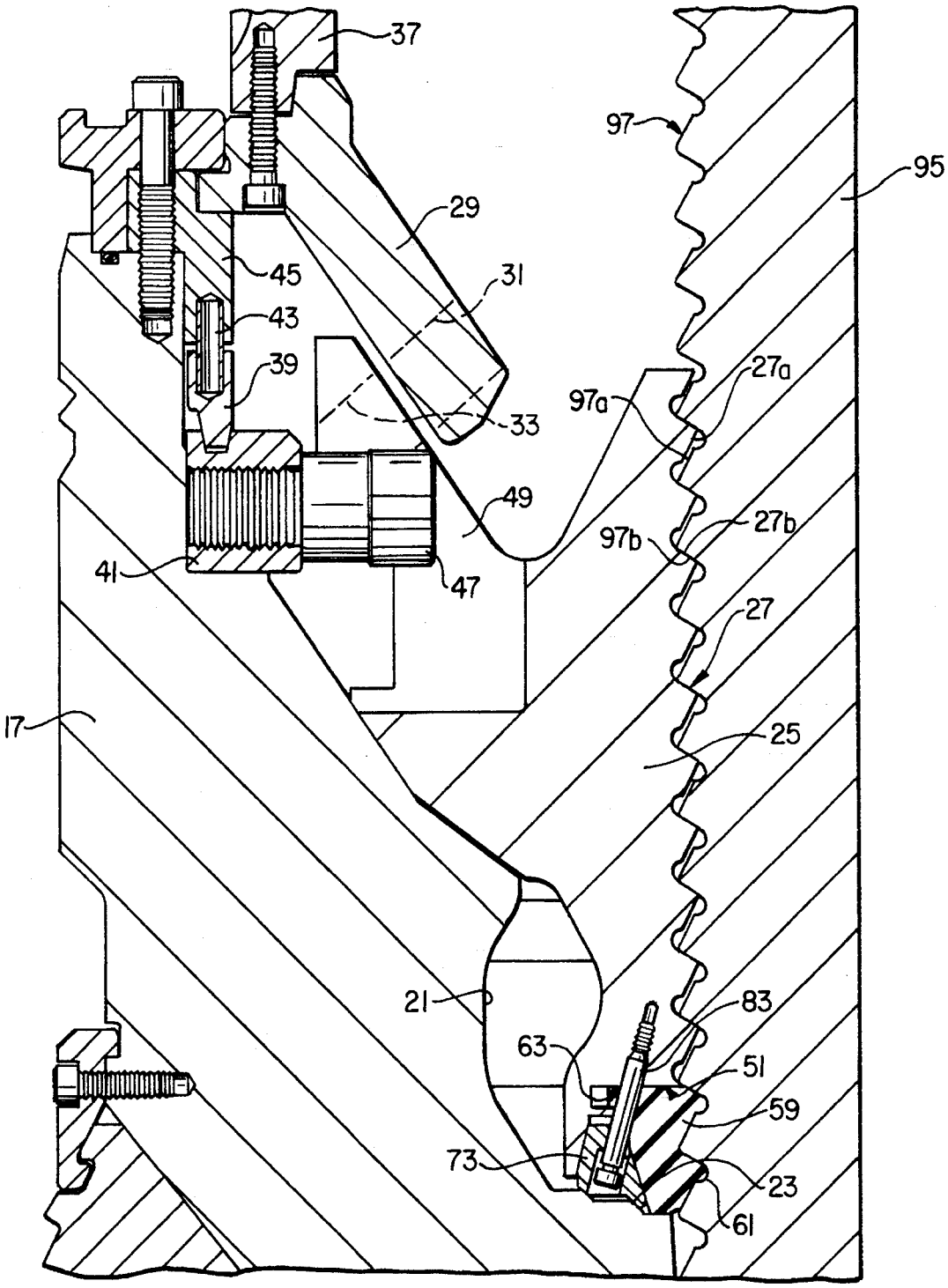
FIG. 5 is a partial enlarged sectional view of the top connector as shown in FIG. 4, but showing the segments in an aligned position.

The movement from the retracted position to the aligned position is handled by a cam ring 29, shown in FIG. 1 and 4–5. Cam ring 29 is an annular member that extends around the upper portion of housing 17. Cam ring 29 has plurality of cam slots 31 that are inclined and extend circumferentially a short distance as well. A pin 33 extends into each cam slot 31. Pin 33 is rigidly secured to a flange 35 of each segment 25. A drive ring 37 is engaged by a tool (not shown) to rotate cam ring 29 relative to housing 17.

It is desired that the segments 25 move straight downward initially in unison from the retracted position and not rotate until pins 33 are located at the ends of slots 31. A stationary clutch ring 39, shown in FIG. 4, frictionally engages a guide ring 41. Guide ring 41 will rotate on a shoulder in bowl 21 once the friction caused by clutch ring 39 is overcome. Springs 43 extend between clutch ring 39 and a stationary support ring 45 which is rigidly mounted to housing 17. A plurality of fingers 47 extend radially inward from guide ring 41 into guide slots 49 formed in each of the segments 25. In this manner, rotating cam ring 29 from the retracted position will not. initially cause segments 25 to rotate with the cam rings 29, because guide ring 41 and fingers 47 will frictionally hold segments 25 in a particular angular orientation. Once the pins 33 are at the ends of the slots 31, the frictional resistance due to springs 43 forcing clutch ring 39 against drive ring 41 is overcome, causing segments 25 and guide ring 41 to rotate while clutch ring 39 and support ring 45 remain stationary.

Referring now to FIG. 2, a recess 51 is formed in the inside surface at the lower end of each segment 25. Recess 51 has a downward facing shoulder 53 that is perpendicular to the axis of bore 19. A radially extending slot 55 extends outward from recess 51. Recess 51 has a wedge surface 57 extending downward and facing generally inward. Wedge surface 57 tapers outward in a downward direction.

An arcuate seal 59 is carried in each recess 51. Each seal 59 is a segment of an annular member and is resilient, preferably elastomeric. The preferred material for seal 59 is Hytrel manufactured by DuPont and having a hardness of approximately 55 shore D. Each seal 59 has seal threads 61 on its inner side. Seal thread 61 makes up the lower termination of a continuous helical threadform that joins the segment threads 27. Seal thread 61 is identical in pitch to segment threads 27. Seal thread 61, however, has an enlarged crest 61a which has a rounded configuration rather than sharp as crest 27c. Each seal 59 has a flange 63 on its upper side that slides within slot 55. The upper side of seal 63 contacts downward facing shoulder 53. Seal 59 has a wedge surface 65 on its outer side that faces generally outward and slightly downward. Wedge 65 tapers inward in a downward direction. Each seal 59 also has at least one slot 67 extending through it, terminating in its upper side.

Figure 3:
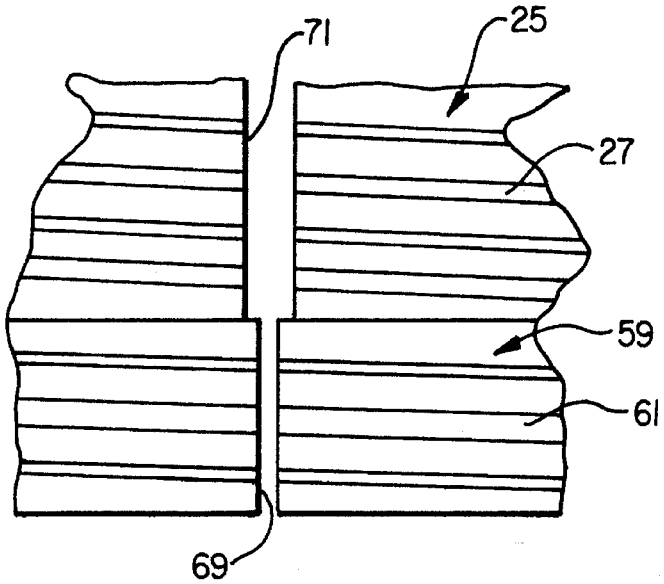
FIG. 3 is partial enlarged schematic front view illustrating two of the segments and two of the seals in a retracted position.

As shown in FIG. 3, each seal 59 is slightly greater in circumferential dimension than its respective segment 25. Each seal 59 has side edges 69 which protrude circumferentially a slight distance past the side edges 71 of the segment 27. When in the retracted position, the spaced apart segment side edges 71 define a slot between segments 27. The seal side edges 69 also define a slot, but of a lesser width. Side edges 69 will abut each other and deform when in the engaged position to form a continuous annular seal.

Referring again to FIG. 2, an actuator 73 is carried by each segment 27 in contact with each seal 59. Each actuator 73 is a metal arcuate member that mounts generally outward of each seal 59. Each actuator 73 has an outer wedge surface 75 that slidingly engages recess wedge surface 57. Each actuator 73 has an inner wedge surface 77 that mates slidingly with seal wedge surface 65. Each actuator 75 has a pair of lower wedge surfaces 79 that mate slidingly with the bowl conical shoulders 23. At least one hole 81 extends through each actuator 73 in alignment with the seal slot 67.

A fastener or bolt 83 extends through the aligned holes 65, 81. Bolt 83 screws into a threaded hole 85 formed in each segment 25. The head 87 of bolt 83 is larger than a shoulder 88 formed in hole 81 to keep the actuator 73 and seal 59 from falling off of segment 25. Bolt 87 is secured to a depth such that head 87 is spaced some distance below shoulder 88 when segments 25 are in the aligned and the fully made up positions. This distance allows actuator 73 to drop by its weight to the lower position shown in FIG. 4 when segments 25 are retracted As shown by the dotted lines 89 of FIG. 2, recess 51 is large enough to allow seals 59 to move between a radial inboard position and a radial outboard position. The inboard position is shown by the solid lines while the outboard position is shown by the dotted lines 89. When moving to the outboard position, seal flange 63 will move radially outward in slot 55. In the outboard position, the seal thread crest 61*a* will be spaced radially inward of the segment crest 27*c*, as indicated by the dimension 91 in FIG. 2. This distance may be about 0.060 of an inch. In the inboard position, unless deformed against shaft 95, crest 61*a* protrudes radially inward of segment crest 27*c* for a dimension 93 as shown in FIG. 2. That dimension may be approximately the same as dimension 91. The length of the slot 67 is approximately twice that of the diameter of bolt 83 for allowing this radial inward and outward movement.

Referring to FIG. 4, shaft 95 is an upper termination of a tendon for top connector 11. Shaft 95 has a set of helical threads with the same pitch and configuration as the segment threads 27 and seal threads 61. Shaft threads 27 have an upper support flank 97*a*, a lower drive flank 97*b*, and a root 97*c* located between each thread.

In operation, segments 25 will initially be retracted, as shown in FIG. 4. Seals 59 will be pushed to the outboard positions, and actuators 73 will be in their lower positions in contact with the heads 87 of bolts 83. The operator then places a tool (not shown) on drive ring 37 and rotates cam ring 29. Cam slots 31 will move relative to pins 33, causing the segments 27 to move straight downward on the conical surfaces of bolt 21. Clutch ring 39, guide ring 41, and fingers 47 prevent rotation of segments 25 as they move downward.

When cam slots 31 are at the opposite ends, segments 25 will be in a lower position, with the segment threads 27 touching the shaft threads 97. Actuators 73 will contact a lower portion of bowl 21, resulting in segments 25 and seals 59 moving downward relative to actuators 73. As the seal 59 is in the outboard position, the seal thread 61 will not be touching the shaft threads 97.

The operator continues rotation of the drive ring 37 and cam ring 29 until the torque required reaches a selected maximum. The segments 25 will rotate on bowl 21 and eventually mesh with shaft threads 97 in the aligned position as shown in FIG. 5. This rotation may be as little as a few degrees or as much as one revolution. In this aligned position, the segment threads 27 are in engagement with shaft threads 97, but not fully made up. A clearance exists between the segment support flank 27*a* and the shaft support flank 97*a*. The drive flanks 27*b* and 97*b* will be in sliding engagement with each other. During this rotational movement, the seal, threads 61 will not be touching the shaft threads 97 to avoid frictional contact which would require high make up loads and might damage the seals 59. When in the aligned position, the seals 59 will have moved toward the inboard position due to the relative movement with actuators 73, but are preferably still not. contacting the shaft threads 97.

Figure 6:
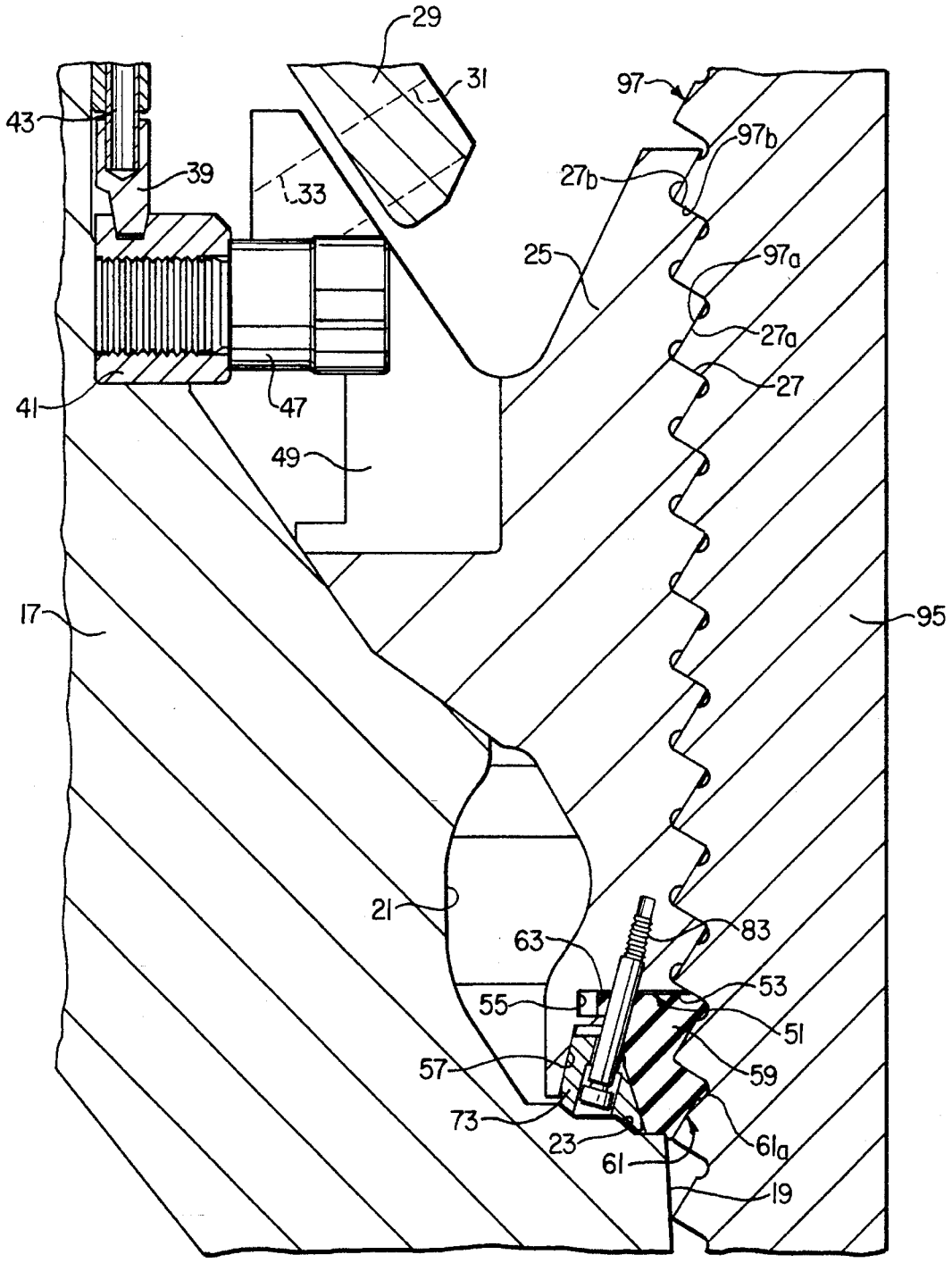
FIG. 6 is a further enlarged sectional view of the top connector as shown in FIG. 5, but showing the segments in a fully made up position and showing the seal in full sealing engagement.

The actuators 73 will partially engage the conical shoulders 23 when in the aligned position. The operator will then cause straight axial movement to occur between housing 17 and shaft 95. This is handled by removing ballast, which causes housing 17 to move upward relative to shaft 95. The axial movement between housing 17 and shaft 95 applies tension to shaft 95 and causes actuators 73 to move further downward in the conical shoulders 23. This results in the segments 25 moving to the fully made up position as shown in FIG. 6. This occurs due to the engagement of the actuator outer wedge surfaces 75 with the recess wedge surface 57. In the fully made up position, the support flanks 27*a* and 97*a* will now be in contact with each other. The final make up of the segments 25 occurs because the conical shoulders 23 are much steeper than the angle of the shaft drive flanks 97*b*.

The final tensioning or axial movement also causes the seals 59 to move radially inward to the full inboard or sealed position. In this position, shown in FIG. 6, seal crest 61*a* fully enters and deforms against the root 97*c* of shaft threads 97, sealing the threads 97. Seals 59 deform against the bottom of the housing bowl 21 near the junction with the lower portion of bore 19, sealing the bowl 21. The seals 59 also deform against the downward facing shoulder 53 of recess 51. The deformation occurs because of the sliding engagement of seal wedge surfaces 65 with the actuator inner wedge surfaces 77. The side edges 69, of the seals 59 (FIG. 3) will abut and seal against each other in the final sealing position. A lock (not shown) may then be employed to lock the segments 25 in place.

The invention has significant advantages. The seal requires less labor to install and may be longer lasting in the environment than the prior art silicone rubber treatment. By allowing the seal to move between an outboard and an inboard position, the seal avoids high make up loads that would otherwise occur if it protruded past the segment threads during make up.

While the invention has been shown in one of its forms, it should be apparent to those skilled in the art that it is not so limited but it is susceptible to various changes without departing from the scope of the invention.

I claim:

1. In an apparatus having a housing having a bore with a bowl, a shaft having an axis and a set of shaft threads passing through the bore, a plurality of segments carried on the bowl and having segment threads on inner sides, and a drive system for sliding the segments down the bowl and rotating the segments into an aligned position aligning the segment threads with the shaft threads, the improvement comprising:

a plurality of arcuate resilient seals, each carried by one of the segments, each seal having an inner side containing a portion of least one seal thread which aligns with one of the shaft threads when the segments are in the aligned position.

2. The apparatus according to claim 1, wherein each of the seals is movable between a radial outboard position and a radial inboard position relative to the segment by which it is carried, and wherein the apparatus further comprises:

actuator means for allowing each of the seals to remain in the outboard position until the segments have been rotated by the drive system to the aligned position, then for moving each of the seals radially inward to the inboard position sealing against one of the shaft threads.

3. The apparatus according to claim 1, wherein each of the seals is movable between a radial outboard position and a radial inboard position relative to the segment by which it is carried, and wherein the apparatus further comprises:

actuator means for allowing each of the seals to remain in the outboard position until the segments have been rotated by the drive system to the aligned position, then for moving each of the seals radially inward to the inboard position sealing against one of the shaft threads in response to straight axial movement of the shaft and housing relative to each other.

4. The apparatus according to claim 1, wherein in the aligned position, the segment threads are a slight distance from being in a fully made up position with the shaft threads, and wherein the apparatus further comprises:

actuator means for allowing each of the seals to remain in an outboard position wherein the seal thread is spaced outboard of the segment threads a slight distance until the segments have been rotated to the aligned position, then for moving each of the seals radially inward to seal against one of the shaft threads and moving each of the segments radially inward to the fully made up position in response to axial movement of the shaft and housing relative to each other.

5. The apparatus according to claim 1 wherein each of the segments has side edges forming slots between the segments and each of the seals has side edges, the side edges of the seals when the segments are retracted protruding slightly past the side edges of the segments which carry them, so that when the segments are moved to the aligned position, the side edges of the seals abut each other.

6. The apparatus according to claim 1, wherein in the aligned position, the segment threads are a slight distance from being in a fully made up position with the shaft threads, and wherein the apparatus further comprises:

a recess at a lower end of each segment for carrying one of the seals, each of the seals being radially movable in the recess between an outboard position and an inboard position, each of the seals being free to remain in the outboard position while the drive system rotates the segments;

a conical shoulder formed in the bowl; and a plurality of actuators, each movably carried by one of the segments, each of the actuators having a bowl wedge surface that engages the conical shoulder, a segment wedge surface that engages one of the segments, and a seal wedge surface that engages one of the seals, such that axial movement of the shaft and housing relative to each other after the segments are in the aligned position, causes the segments to move from the aligned position to the fully made up position and causes the seals to move to the inboard position to seal against one of the shaft threads.

7. In an apparatus having a housing having a bore with a bowl, a shaft having an axis and a set of shaft threads passing through the bore, a plurality of segments carried on the bowl and having segment threads on inner sides, and a drive system for sliding the segments down the bowl and rotating the segments into an aligned position aligning the segment threads with the shaft threads, the improvement comprising:

a plurality of arcuate resilient elastomeric seals, each carried by one of the segments, each seal having an inner side containing a portion of least one seal thread which aligns with one of the shaft threads when the segments are in the aligned position, each of the seals being radially movable between an outboard position and an inboard position relative to the segment by which it is carried;

each of the seals being free to remain in the outboard position while the drive system slides the segments down the bowl and rotates the segments to the aligned position, so as to avoid tight frictional engagement with the shaft threads during the rotation by the drive system;

a conical shoulder formed in the bowl; and a plurality of actuator members, each carried by one of the segments for movement relative to the segment by which it is carried, the actuator members being positioned to slidingly engage the conical shoulder in the bowl in response to straight axial movement of the housing and the shaft relative to each other after the segments are in the aligned position, and to thereby push the segments to a fully made up position and push the seals to the inboard position sealed against at least one thread of the shaft.

8. The apparatus according to claim 7 wherein in the outboard position, the thread of the seals is spaced radially outboard a slight distance from the threads of the segments and in the inboard position, the thread of the seals is spaced radially inboard a slight distance from the threads of the segments so as to deform in interference when the actuator moves the seals to the inboard position.

9. The apparatus according to claim 7 wherein each segment has side edges forming slots between the segments and each of the seals has side edges, the side edges of the seals when the segments are retracted protruding slightly past the side edges of the segments which carry them, so that when the seals are in the inboard position, the side edges of the seals abut each other.

10. The apparatus according to claim 7 wherein:

a recess is formed at a lower end of each segment for carrying one of the seals, the recess having a generally radially inward facing wedge surface; and each of the actuators is carried in the recess and has a generally radially outward facing outer wedge surface that slidingly engages the wedge surface of one of the recesses, a lower wedge surface that slidingly engages the conical shoulder, and an inner wedge surface on an inner side that slidingly engages an outer surface of one of the seals.

11. The apparatus according to claim 7 wherein each of the seals and actuators is carried by at least one fastener extending through holes provided in the seals and actuators, the fasteners being secured to the segments.

12. In an apparatus having a housing having a bore with a bowl and a shaft having an axis and a set of shaft threads passing through the bore, an improved means for mounting and sealing the shaft and the housing to each other, comprising in combination:

a plurality of segments carried on the bowl and having segment threads on inner sides;

at least one conical shoulder formed in the bowl;

drive means for sliding the segments down the bowl and rotating the segments into an aligned position which aligns the segment threads with the shaft threads but does not fully make up the segment threads with the shaft threads;

a recess formed on an inner side of each of the segments at a lower end of each of the segments;

a plurality of arcuate elastomeric seals, each carried in one of the recesses by one of the segments, each seal having an inner side containing a portion of least one seal thread which aligns with one of the shaft threads when the segments are in the aligned position;

a plurality of actuators, each carried by one of the segments in engagement with an outer side of one of the seals;

fastener means mounting each of the seals and each of the actuators to one of the segments so that each of the seals is radially movable in the recess to an outboard position while the drive means slides the segments down the bowl and rotates the segments to the aligned position, so as to avoid tight frictional engagement of the thread of the seals with the shaft threads during the rotation by the drive system; and the actuators being positioned to slidingly engage the conical shoulder in the bowl in response to straight upward axial movement of the housing relative to the shaft after the segments are in the aligned position, and to thereby push the segments to a fully made up position and push the seals to an inboard position sealed against at least one thread of the shaft.

13. The apparatus according to claim 12 wherein in the outboard position, the thread of the seals is spaced radially outboard a slight distance from the threads of the segments and in the inboard position, the thread of the seals is spaced radially inboard a slight distance from the threads of the segments so as to deform in interference when the actuator moves the seals to the inboard position.

14. The apparatus according to claim 12 wherein each segment has side edges forming slots between the segments and each of the seals has side edges, the side edges of the seals when the segments are retracted protruding slightly past the side edges of the segments which carry them, so that when the seals are in the inboard position, the side edges of the seals abut each other.

15. The apparatus according to claim 12 wherein:

the recess having a generally radially inward facing wedge surface that tapers outward in a downward direction; and each of the actuators is carried in the recess and has a generally radially outward facing outer wedge surface that slidingly engages the wedge surface of the recess, a lower wedge surface that slidingly engages the conical shoulder, and an inner wedge surface that slidingly engages the outer side of one of the seals.

16. The apparatus according to claim 12 wherein:

the recess has a downward facing shoulder, a slot extending outward from the downward facing shoulder, and a generally radially inward facing wedge surface that tapers outward in a downward direction;

each of the seals has a flange that slidingly locates in the slot, an upper surface that engages the downward facing shoulder, and wherein the outer side of each of the seals is tapered inward in a downward direction;

each of the actuators is carried in the recess and has a generally radially outward facing outer wedge surface that slidingly engages the wedge surface of the recess, a lower wedge surface that slidingly engages the conical shoulder, and an inner wedge surface that slidingly engages the outer side of one of the seals.

17. The apparatus according to claim 12 wherein the fastener means comprises at least one fastener extending through holes provided in the seals and actuators, the fasteners being secured to the segments.

18. A method for supporting and sealing a shaft with a housing having a bore with a bowl, the shaft having an axis and a set of shaft threads and passing through the bore, comprising:

providing a plurality of segments having segment threads on inner sides;

mounting an arcuate resilient seal to each of the segments and providing each of the resilient seals with an inner side containing a portion of least one seal thread; and sliding the segments down the bowl and rotating the segments into an aligned position aligning the segment threads with the shaft threads; and forcing the seals into sealing engagement with one of the shaft threads.

19. The method according to claim 18 wherein the step of forcing the seals into sealing engagement with one of the shaft threads occurs after the step of rotating the segments has been completed.

20. The method according to claim 18 wherein:

the step of mounting an arcuate resilient seal to each of the segments comprises mounting each of the seals so as to be radially movable relative to the segments to an outboard position;

during the step of rotating the segments, the seals will be free to be in the outboard position so as to avoid tight frictional engagement with the shaft threads during said rotation; and the step of forcing the seals into sealing engagement with one of the shaft threads occurs after the step of rotating the segments has been completed.

21. The method according to claim 18 wherein:

the step of mounting an arcuate resilient seal to each of the segments comprises mounting each of the seals so as to be movable relative to the segments to an outboard position wherein the seal thread is radially outward of the segments threads;

during the step of rotating the segments, the seals will be free to be in the outboard position so as to avoid tight frictional engagement with the shaft threads during said rotation; and the step of forcing the seals into sealing engagement with one of the shaft threads occurs after the step of rotating the segments has been completed and occurs by the housing and shaft relative to each other with straight axial movement.

22. The method according to claim 18 wherein:

the step of mounting an arcuate resilient seal to each of the segments comprises mounting each of the seals so as to be movable relative to the segments to an outboard position wherein the seal thread is radially outward of the segments threads;

during the step of rotating the segments, the seals will be free to be in the outboard position so as to avoid tight frictional engagement with the shaft threads during said rotation; and the step of forcing the seals into sealing engagement with one of the shaft threads occurs after the step of rotating the segments has been completed and occurs by the housing and shaft moving relative to each other with straight axial movement; and wherein the method further comprises:

moving the segments from the aligned position to a fully made up position by said straight axial movement of the housing and shaft relative to each other.

23. A method for supporting and sealing a shaft with a housing having a bore with a bowl, the shaft having an axis and a set of shaft threads and passing through the bore, comprising:

providing a plurality of segments having segment threads on inner sides;

mounting an arcuate resilient seal to each of the segments so as to be radially movable relative to the segment between a radial outboard position and an inboard position, and providing each of the resilient seals with an inner side containing a portion of least one seal thread;

mounting an actuator to each of the segments, each of the actuators being in engagement with one of the seals; and while allowing each of the seals to be in the outboard position, sliding the segments down the bowl and rotating the segments into an aligned position aligning the segment threads with the shaft threads; then by straight downward movement of the housing relative to the shaft, causing the actuators to slidingly move on the bowl, thereby forcing the seals to the inboard position in sealing engagement with one of the shaft threads and forcing the segments to a fully made up position.

24. The method according to claim 23 wherein:

in the outboard position, the seal thread is radially outward of the segment threads a slight distance.

* * * * *